United States Patent [19]

LePisto et al.

[11] Patent Number: 5,009,016

[45] Date of Patent: Apr. 23, 1991

[54] METHOD FOR ON-MACHINE COATING-DRYING OF A PAPER WEB OR THE LIKE

[75] Inventors: Matti LePisto, Turku; Reijo Ilmanen, Piikkio; Markku Karlsson, Parainen; Sauli Laakso, Masku, all of Finland

[73] Assignee: Valmet Oy, Helsinki, Finland

[21] Appl. No.: 381,674

[22] PCT Filed: Nov. 26, 1987

[86] PCT No.: PCT/FI87/00159

§ 371 Date: Jul. 14, 1989

§ 102(e) Date: Jul. 14, 1989

[87] PCT Pub. No.: WO89/04890

PCT Pub. Date: Jun. 1, 1989

[51] Int. Cl.[5] ..... F26B 3/32

[52] U.S. Cl. ..... 34/41; 34/124; 34/119; 432/8; 432/59

[58] Field of Search ..... 432/8, 59; 34/41, 124, 34/119

[56] References Cited

U.S. PATENT DOCUMENTS

| | | | |
|---|---|---|---|
| 3,826,014 | 7/1974 | Helding | 34/41 |
| 3,972,127 | 8/1976 | Hoshi et al. | 34/41 |
| 4,143,468 | 3/1979 | Novotny et al. | 34/41 |
| 4,678,433 | 7/1987 | Ellison | 432/72 |
| 4,821,427 | 4/1989 | Chern | 34/124 |
| 4,882,853 | 11/1989 | Schaft | 34/41 |

*Primary Examiner*—Henry C. Yuen

*Attorney, Agent, or Firm*—Cohen, Pontani & Lieberman

[57] ABSTRACT

A method for contact-free drying of a paper or board web or of any other corresponding continuous web. During drying, both infrared radiation and drying air jets are used. The web is carried by the air jets through the dryer free of contact. The moving web is first passed into an infrared drying gap, in which a drying energy pulse of relatively short duration is directed at the web, the power of the energy pulse being substantially higher than the average drying power of the dryer per unit of area. After the infrared drying gap, the web is immediately passed into an airborne web drying gap wherein the web is supported and dried by means of air jets. Air is brought into the infrared unit, which air having been heated in the infrared unit is passed as replacement air and/or drying air for the airborne web drying unit or units placed after the infrared unit. The air flows to be passed into the infrared unit are passed in connection with the inlet gap of the web to both sides of the web so as to form both accompanying and sealing air jet flows.

8 Claims, 9 Drawing Sheets

METHOD FOR ON-MACHINE COATING-DRYING OF A PAPER WEB OR THE LIKE

BACKGROUND AND SUMMARY OF THE INVENTION

The invention concerns a method for contact-free drying of a paper or board web, or of any other corresponding continuous web, in which method both infrared radiation and drying air jets are used for drying, the air jets also supporting the web as it runs through the dryer, so that the web is carried free of contact, preferably from two sides, and in which method, after the infrared drying gap, the web is substantially immediately passed into an airborne web-drying gap, wherein the web is supported and dried by means of air jets.

Also included herein is a description of a device intended for carrying out the method of the invention, which device comprises an infrared drying unit and an airborne web-drying unit or airborne web-drying units, which infrared drying unit comprises a series of infrared radiators and an infrared treatment gap fitted in its connection, through which gap the web to be dried can be passed. The airborne web-drying unit or units comprise a box portion, inside of which a nozzle box or boxes are fitted, in connection with which there are nozzle parts, through which drying and supporting air jets are applied to the web to be dried. The infrared drying unit and airborne web-drying unit are integrated with each other both structurally and functionally, and the infrared unit is placed, in the direction of running of the web to be dried, immediately before the airborne web-drying unit.

The present invention relates to the drying of a paper web, board web, or of any other corresponding moving web. A typical object of the invention is the drying of a paper web in connection with its coating or surface-sizing.

As is known in the prior art, paper webs are coated either by means of separate coating devices or by means of on-machine devices or surface-sizing devices integrated in paper machines and operating in the drying section of a paper machine. At the final end of a multi-cylinder dryer, the web to be coated is passed to a coating device, which is followed by an intermediate dryer and finally, e.g., by one group of drying cylinders as an after-dryer. A typical application of the present invention is the intermediate dryer after the coating device, the invention being, however, not confined to the intermediate dryer alone.

In the prior art, so-called airborne web dryers are known, wherein a paper web, board web, or equivalent is dried free of contact. Airborne web dryers are used, e.g., in paper coating devices after a roll coater or a spread coater to support and to dry the web, which is wet with the coating agent, free of contact. In airborne web dryers various blow nozzles and nozzle settings for drying and supporting air are applied. The blow nozzles can be divided into two groups, i.e. pressure or float nozzles, and negative-pressure or foil nozzles, both of which can be applied in the dryer and the method in accordance with the invention.

The prior art airborne web dryers that are used most commonly are based exclusively on air flows. It is partly for this reason that the airborne web dryer becomes quite spacious, since the distance of effect of the airborne web dryer must be relatively long in order that a sufficient high drying capacity could be obtained.

Another reason for these drawbacks is that in air drying the depth of penetration of the drying remains relatively low.

In the prior art, different dryers are known which are based on the effect of radiation, in particular of infrared radiation. The use of infrared radiation provides the advantage that the radiation has a relatively high depth of penetration, which depth of penetration is increased when the wavelength becomes shorter. The use of infrared dryers in the drying of paper webs has been hampered, e.g., by the risk of fire, because the temperatures in infrared radiators become quite high, e.g. 2000° C., in order that a drying radiation with a sufficiently short wavelength could be achieved.

With respect to the prior art, reference is made to the German published Patent Application (DE OS) No. 2,351,280, which describes a sort of a combination of an airborne web dryer and an infrared dryer operating by means of pressure nozzles. In the patent application mentioned above, a one-sided airborne web dryer is described, which comprises nozzle boxes placed one after the other at distances from each other. The edge portions of these boxes are provided with nozzle slots, through which air jets are directed at the web placed above expressly perpendicularly. The air jets are deflected outward from the nozzle box when they meet the web. Between the nozzles, infrared radiators are fitted, which fill the gap between the nozzles. This type of dryer has not become widely used, probably due to the fact that the nozzle construction has not been successful in providing a constructionally or energy-economically favorable combination of air drying and radiation drying. Moreover, the construction is one-sided, and it requires a relatively abundant space in the direction of running of the web if sufficiently high drying capacities are to be reached, e.g., in paper finishing plants.

Particular problems in infrared drying have been the strong formation of dust and high humidity of air.

Electric infrared dryers, used separately or exclusively, are also energy-economically unfavorable owing to the relatively high cost of electric energy, as compared, e.g., with natural gas.

In paper coating stations, including on-machine coating stations, separate infrared dryers have been used whose drying is based exclusively on the radiation effect. However, use of these infrared dryers has not yielded a sufficiently good adjustability of paper quality and evaportion. Moreover, the drying process becomes highly dependent on the operating quality of the infrared dryer.

It is an object of the present invention to solve the problem described above.

It is a particular object of the present invention to develop a novel application of an infrared dryer, in which the air technique particularly has been solved in a better way than in the prior art.

A further object of the invention is to provide a method and to describe a device by means of which the overall control of the coating-drying of a paper web can be improved.

Another objective of the invention is to provide a novel application of an infrared dryer so that it is possible to attain a dryer with more favorable investment costs and operating costs, as compared with the prior art. In view of achieving this objective by means of the invention, attempts are made to obtain a higher drying capacity, a lower size of equipment, and a lower heat and humidity load in the machine hall.

It is a particular object of the invention to provide an infrared dryer that can be used for adjusting the ultimate moisture profile of the web produced by the paper machine.

In view of achieving the objectives given above, as well as others, the method of the invention is mainly characterized as follows:

the moving web is first passed into an infrared drying gap in which a drying energy pulse of relatively short duration is directed at the web, the power of the energy pulse being substantially higher than the average drying power of the dryer per unit of area, and air is brought into the infrared unit, which air, having been heated in the infrared unit, is passed as replacement air and/or drying air for the airborne web-drying unit or units placed after the infrared unit.

On the other hand, the drying device in accordance with the invention is mainly characterized in that the infrared unit comprises air and nozzle devices, through which air flows can be passed into the treatment gap of the infrared unit and/or in connection with the heated parts of the infrared unit, which air flows are passed for replacement and/or drying air for the subsequent airborne web-drying unit or units.

By means of the invention, it is possible to accomplish drying with improved overall profitability, wherein both the investment costs and the operating costs are taken into account.

Owing to the invention, an increased evaporation capacity, a reduced heat and humidity load in the machine hall, as well as economies in the lifting and auxiliary equipment for the infrared dryer are obtained. On the basis of measurements, drying test runs, and theoretical examinations carried out by the inventor, it has been ascertained that the solution of the invention, from an evaporation standpoint, and also in view of the quality of the paper web, results in a considerable improvement over the prior art dryer arrangements in which the infrared dryer and the airborne web dryer are provided as separate, independently operating units.

The method and device in accordance with the invention are particularly well suited for an on-machine dryer after a coating or surface-sizing apparatus and moreover, if necessary, also for adjustment of the ultimate moisture profile of the paper web.

In the present invention, an open hood does not have to be constructed above the dryer, which is the case in the prior art devices, for in the infra-airborne combination of the invention mere spot exhaustion is enough, because the system of exhaust ducts in the airborne web dryer provides adequate ventilation.

When natural gas or a corresponding fuel is used for the heating of the drying air for the airborne web dryer unit or the heating of the drying air for the airborne web dryer unit or units, the operating cost of the method and the device making use of the invention per unit of quantity of evaporated water becomes considerably more favorable as compared with a dryer in which electric infrared drying along would be used. This advantage is due to the fact that in the invention the energy transferred into the paper web in the electric infrared unit is utilized efficiently in the airborne web drying unit or units following after the infrared unit.

BRIEF DESCRIPTION OF THE DRAWINGS

In the drawings, wherein like reference characters denote similar elements throughout the several views.

FIG. A shows the layout of an on-machine coating-dryer of a prior art paper machine.

DETAILED DESCRIPTION OF THE PREFERRED EMBODIMENTS

Figure 1:
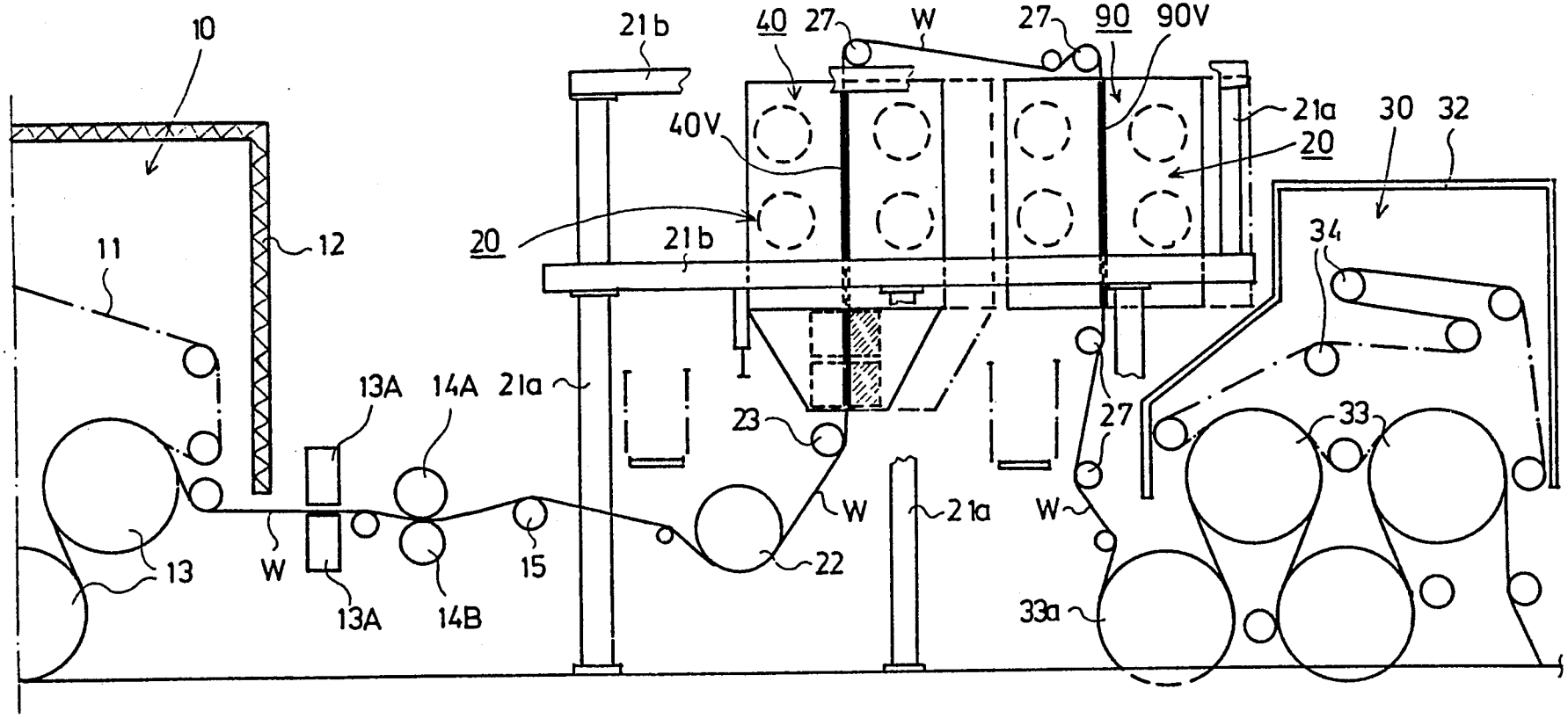
FIG. 1 shows, in a way corresponding to FIG. A, the layout of a drying method and dryer in accordance with the present invention.

FIG. A shows a prior art paper finishing and coating station placed in the drying section of a paper machine, wherein a prior art drying arrangement is used. As is shown in FIG. A, the paper web W is passed over the cylinders 13 of a normal multi-cylinder dryer 10 placed inside a hood 12. The upper drying wire in the drying section 10 is denoted with reference numeral 11. The multi-cylinder dryer 10 is followed by measurement beams 13A placed across the web W, in connection with which said beams 13A there are measurement detectors known in the art, such as detectors for the measurement of the web moisture and grammage. The measurement beams 13 are followed by an intermediate press formed by the rolls 14A and 14B, whereinafter the web W is passed, being guided by the guide rolls 15, into a coating station 20A in itself known. The coating station 20A comprises a coating unit and, after it, an infrared dryer 25 and a separate airborne web dryer 26.

The vertical beams in the frame of the coating station 20A are denoted with reference numeral **21*a*, and the horizontal beams with reference numeral 21*b*. After the coating unit 22, the web W is transferred, being guided by a guide roll 23, into the treatment gap 25V of a separate infrared dryer 25. The web W dried in the said treatment gap 25V is passed as remarkably long draws over the cylinder 23A into the treatment gap 26V of an airborne web dryer 26, wherein the web W is supported free of contact and wherein it is, at the same time, dried by means of air jets discharged out of the nozzles (not shown) of the airborne web dryer 26**.

After the airborne web dryer 26, the web W is transferred, guided by the guide rolls 27, to an after-dryer 30, whose first cylinder **33*a* is not provided with a felt. The after-dryer 30 is placed inside a hood 32, and its upper felt, which is guided by guide rolls 34, is denoted with reference numeral 31. The after-dryer 30 has, for example, only one cylinder group, which comprises, for example, four drying cylinders 33a and 33. After the after-dryer 30**, the fully dried and coated web W is passed to the reeling device (not shown).

Having described a prior art coating station 20A in considerable detail, the operation and the capacity of the method and the device in accordance with the present invention will now be compared with the drying method and device in accordance with FIG. A.

FIG. 1 shows a similar coating and drying process as in FIG. A, however the coating station 20A shown in FIG. A has been substituted with a coating station 20 in accordance with the present invention. It can be imagined that the coating station shown in FIG. A has been modernized by providing its coating station 20 with a novel dryer 40 in accordance with the invention, which is placed in connection with the frame part 21a and 21b of the earlier coating station 20A. In this modernization the multi-cylinder dryer 10 and the after-dryer 30 have remained unchanged. However, it should be emphasized that the dryer 40 in accordance with the invention is also suitable for many other applications, besides the application and position shown in FIG. 1.

The coating station 20 shown in FIG. 1 consists of a prior art coating station 22 and an infrared-airborne web dryer 40 in accordance with the invention and of a separate conventional airborne web dryer 90 placed after same. The web W runs upwards vertically through the treatment gap 40V of the infrared-airborne web dryer 40 and thereupon, guided by the guide rolls 27, as a substantially horizontal run into the vertical treatment gap 90V in the airborne web dryer 90, running downwards therein. From the treatment gap 90V the web W is passed further, guided by the guide rolls 27, onto the first drying cylinder 33a and, in a way known in prior art, further through the after-dryer 30.

The more detailed construction of the infrared-airborne web dryer 40 can be seen in the attached FIGS. 2, 2A, 2B, 2C, and 2D. The infrared-airborne web dryer 40 comprises an infrared drying unit 50, through whose treatment gap the web W is passed free of contact, while it is, at the same time, dried by means of infrared radiation R. A component integrated via air flow as well as structurally integrated with the infrared unit 50 is the airborne web dryer 80, which comprises a box part 81 of the dryer and, fitted in the box part, an upper nozzle box 82A and a lower nozzle box 82B. In the upper nozzle box 82A there are several nozzle units 85a uniformly spaced at a distance H, and correspondingly in the lower nozzle box 82B there are nozzle units 85b uniformly spaced at a distance H, so that a treatment gap 80V is formed, through which the web W to be dried and supported runs, meandering gently and substantially sinusoidally as drying and supporting hot air jets are directed at it from both sides.

Figure 2:
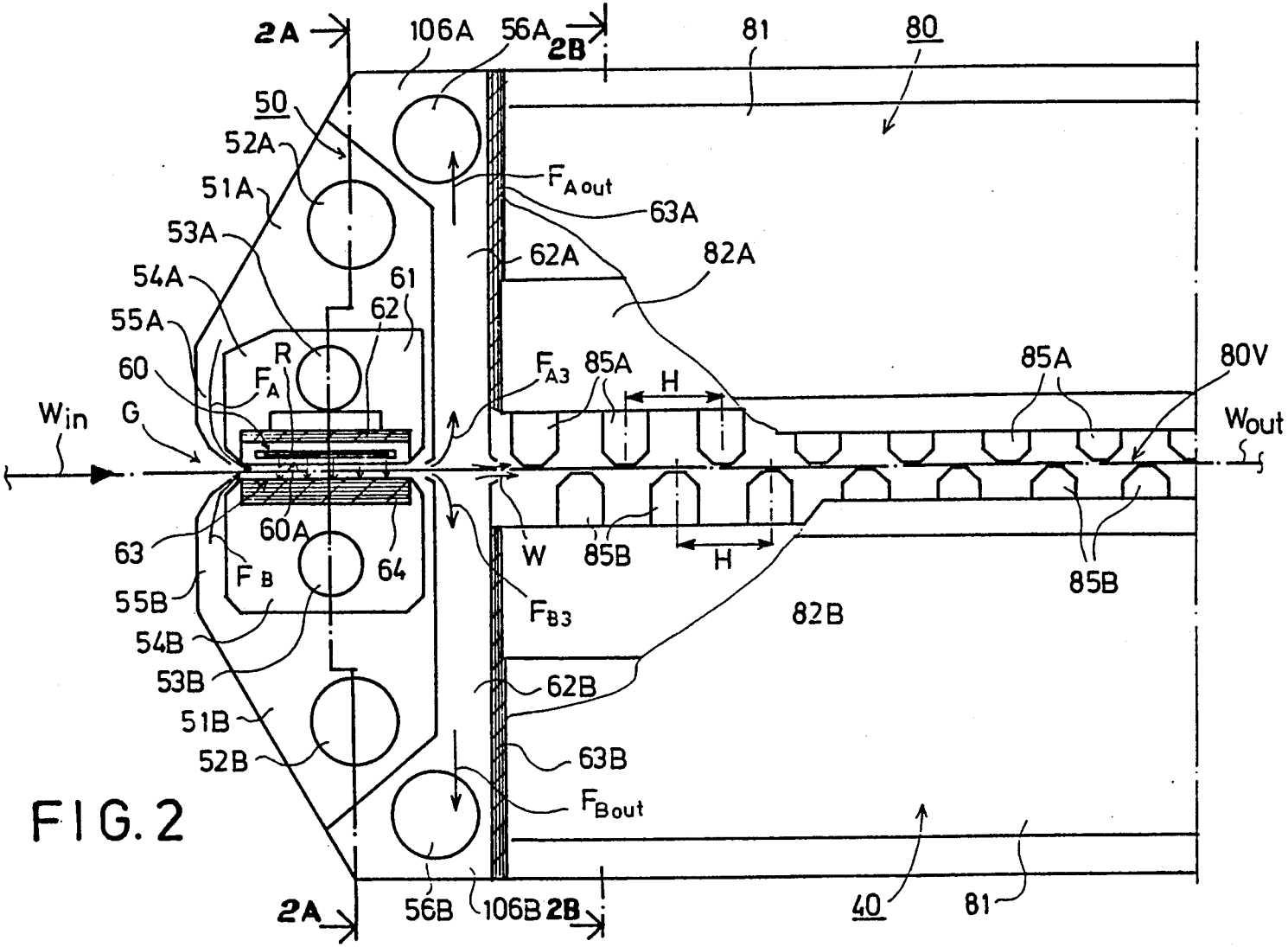
FIG. 2 is a side view of an infrared-airborne web-drying unit in accordance with the invention.
Figure 3:
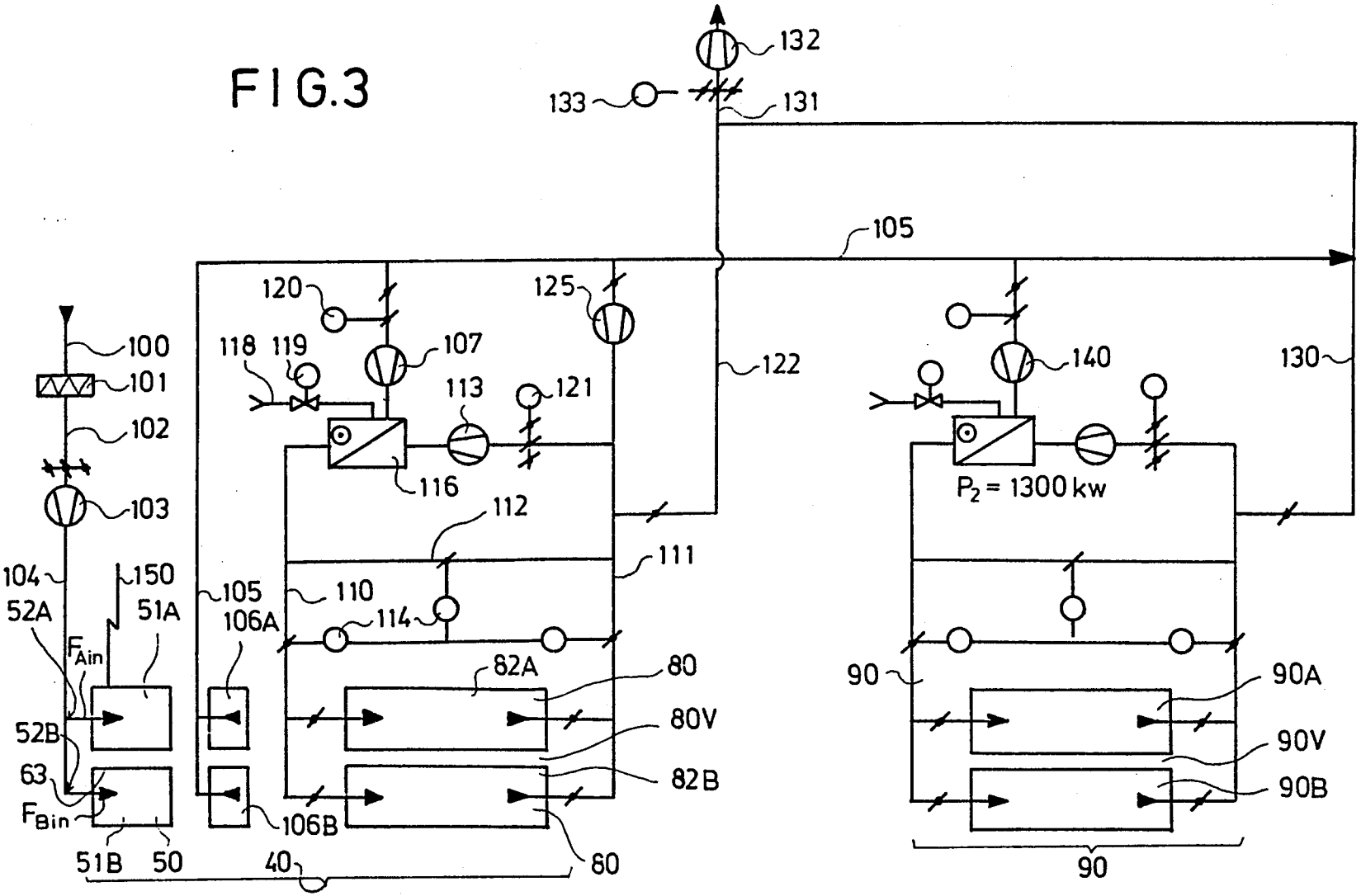
FIG. 3 illustrates the method of the invention as an air-flow diagram.

As is seen from FIGS. 2 and 3, in the invention the infrared drying unit 50 and the airborne web drying unit 80 are integrated as a novel drying unit both structurally and from the point of view of the drying process, mainly in consideration of the drying energy technique matters and of the optimal drying process and draw of the web. This novel drying technique and air flow technique integration is the essence of the invention.

In the infrared-airborne web dryer 40 in accordance with the invention, the cooling air needed by the infrared dryer 50 is blown through the nozzles 55A and 55B so as to constitute replacement air for the airborne web drying unit 80 and/or 90. In the invention, the leakage air entering into the airborne web dryer unit 80 can be sealed, and the energy of the hot cooling air coming from the infrared dryer 50 can be utilized efficiently. The combined infrared-airborne web dryer 40 in accordance with the invention permits a strong evaporation energy peak to be applied to the web immediately after the coating process and at the beginning of the drying process (as seen in FIG. 4, to be referred to later).

In the following, with reference to FIGS. 2, 2A, 2B, 2C, 2D, 3, and 4, the details of the construction and operation of the infrared-airborne web dryer 40 will be described. It is an essential feature of the invention that the infrared dryer unit 50 is placed before the airborne web drying unit 80, in the direction of running $W_{in}$-$W_{out}$ of the Web to be dried. The infrared drying unit 50 comprises an upper box part 51A and a lower box part 51B. At their front side, these box parts 51A and 51B define a gap part G, into which the web $W_{in}$ is passed. From the gap part G, an air-sealed inlet nozzle and a gap for infrared treatment of the web W start, wherein the web W is supported and stabilized by means of air jets $F_A$ and $F_B$ and wherein it is, at the same time, heated and dried by means of infrared radiation R.

The infrared unit 50 comprises an upper box part 54A and a lower box part 54B. Air pipes 53A and 53B are connected to the box parts. In the upper box 54A there is a series of infrared radiators 60, above which there is a reflecting face 62 placed inside a heat insulation 61. At the opposite side of the treatment gap, on a heat insulation 64, there is a reflecting face 63, which reflects any infrared radiation R that has passed through the web W back so as to act upon the web W. In connection with the inlet gap G, the boxes 51A and 54A define an accompanying air duct 55A, and correspondingly, at the lower side, the boxes 51B and 54B define a lower accompanying air duct 55B, from which, out of the air passed into the boxes 51A and 51B through the pipes 52A and 52B, accompanying air flows $F_A$ and $F_B$ are blown, which support and stabilize the web W in the infrared-treatment gap and ventilate the gap. In the infrared-treatment gap the air jets $F_A$ and $F_B$ are heated, and this heat is recovered by means of the arrangements illustrated in FIGS. 2A and 3, which will be referred to later.

Figure 2A:
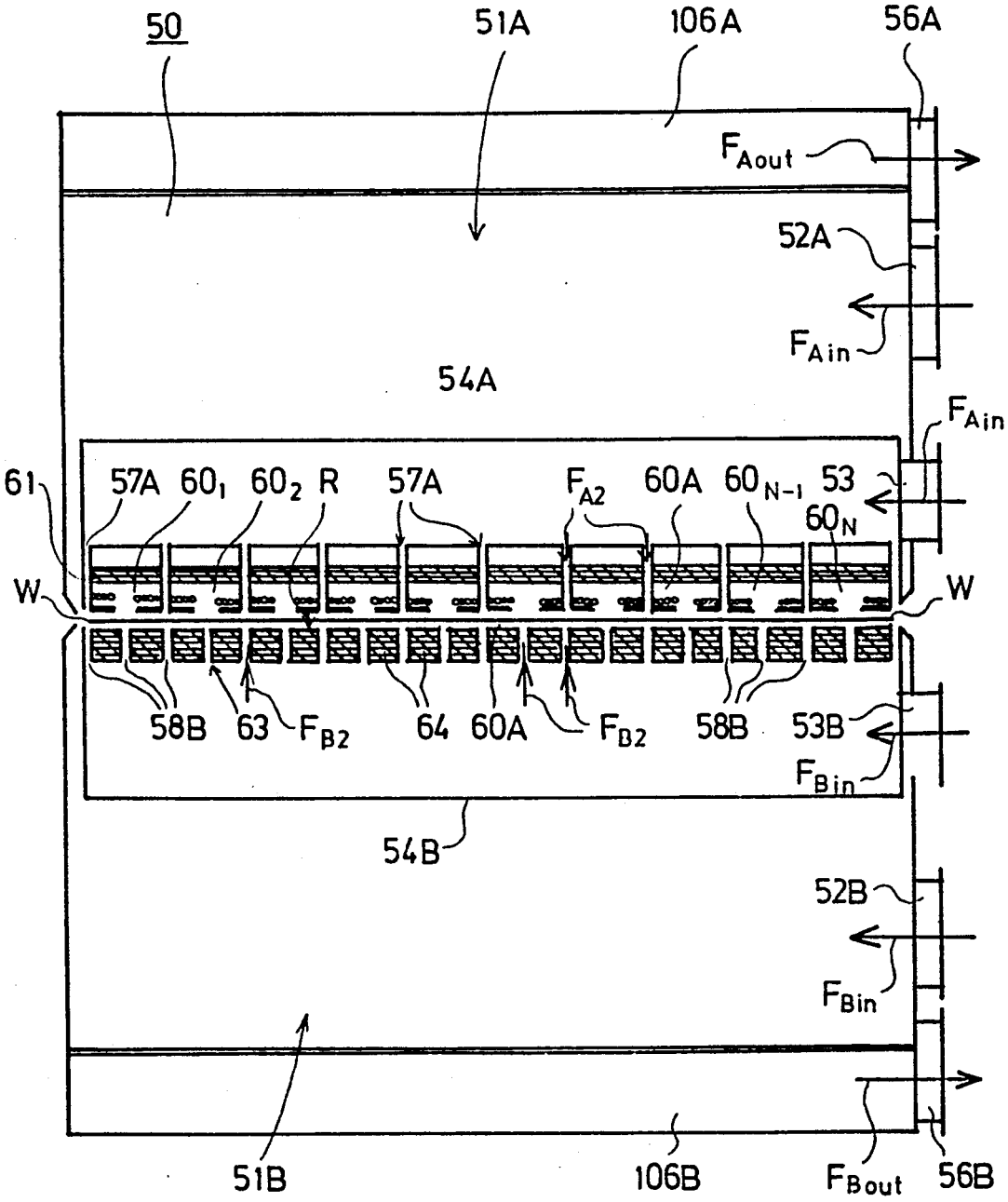
FIG. 2A shows a section A—A in FIG. 2.
Figure 2B:
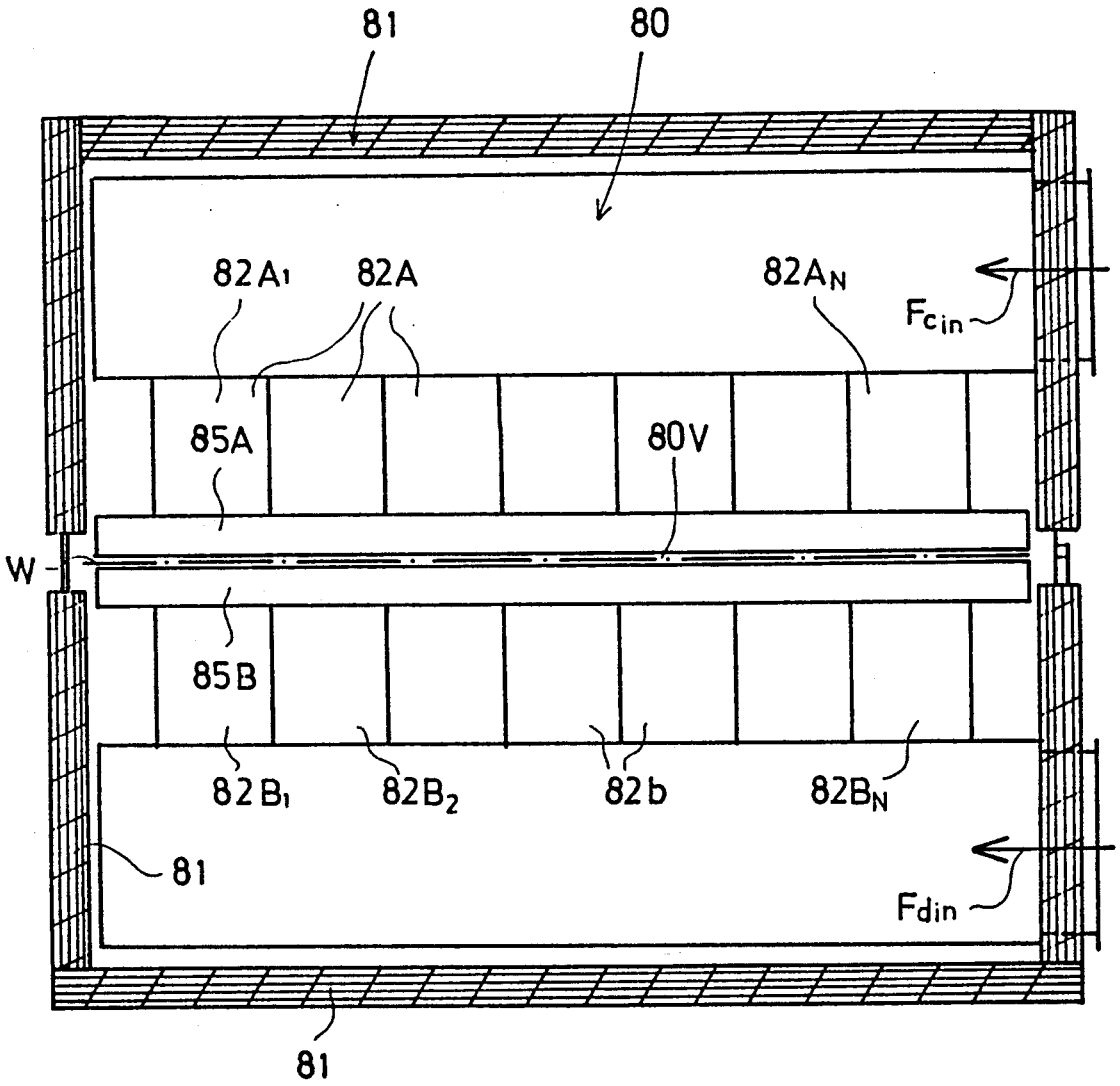
FIG. 2B shows a section B—B in FIG. 2.

In FIG. 2A, which is section A—A in FIG. 1, it is shown that the air introduced through the duct 104 of the blower 103 (FIG. 3) is blown as air flows $F_{Ain}$ through the pipe 52A and 54A into the upper box parts 51A, 54A of the infrared unit 50, from which the air flows are directed mainly into the infrared-treatment gap so as to constitute the above described flow $F_A$. As shown in FIGS. 2 and 2A, the inlet flows $F_{Bin}$ from the pipes 52B and 53B connected to the duct 104 are passed into the lower box part 51B of the infrared unit 50 (FIG. 3), which said inlet flows $F_{Bin}$ are directed substantially so as to constitute the above accompanying flow $F_B$. The flows $F_{Ain}$ and $F_{Bin}$ passed into the inner box parts 54A and 54B surrounding the infrared-treatment gap are guided in the direction of the arrows $F_{A2}$ and $F_{B2}$ so as to cool the parts heated by the infrared radiation, and these cooling flows are at least partly passed into the infrared treatment gap and join the sealing and accompanying flows $F_A$ and $F_B$. After the infrared-treatment gap, ducts 62A and 62B are opened at the proximity of the web W over the entire width of the web W, the ducts 62A and 62B communicating with the boxes 106A and 106B. From the boxes 106A and 106B, pipes 56A and 56B start, which are connected to the pipe 105 seen in FIG. 3. The boxes of the infrared unit 50 and of the airborne unit 80 have an integrated construction, and between the units there are partition walls 63A and 63B, which are provided with heat insulation if necessary. Even though, in connection with FIG. 2, the web is shown as passing in a horizontal plane through the infrared-treatment gap and the immediately following treatment gap 80V of the airborne web drying unit, the run of the web may equally well be slanting or vertical, as is the case in the embodiment shown in FIG. 1. The vertical run starting from the gap G may also be directed downwards from above.

The infrared radiators 60 are divided, in the transverse direction of the web W, into compartments $60_1 \ldots 60_N$, into each of which compartments it is possible to supply an adjustable electric power through the electric conductor 150 (FIG. 3) so that the transverse profile of the heating effect can be controlled by means of electric systems in themselves known. The profile control system also includes devices (not shown) for the measurement of the transverse moisture profile.

Below the infrared units 60, placed facing the treatment gap, there are windows 60A, through which the infrared radiation R is applied to the web W and penetrates into the web, partly passing through the web W and returning back from the reflecting face 63 so as to act upon the web W.

Figure 2D:
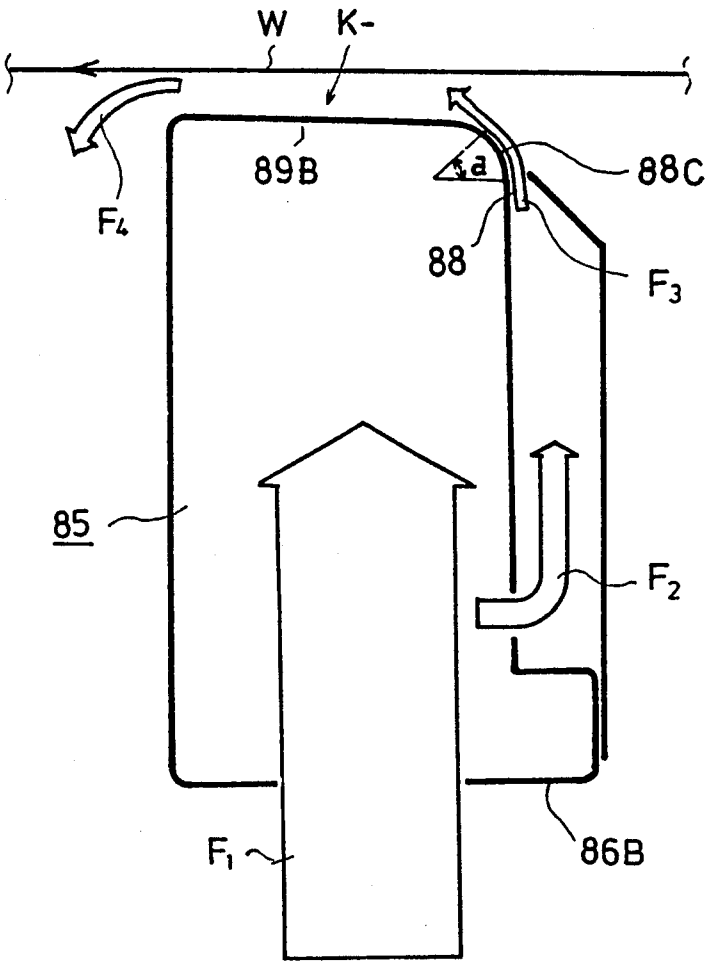
FIG. 2D shows an alternative for the nozzle shown in FIG. 2C, i.e. a one-sidedly blowing coanda nozzle unit with negative pressure.
Figure 2C:
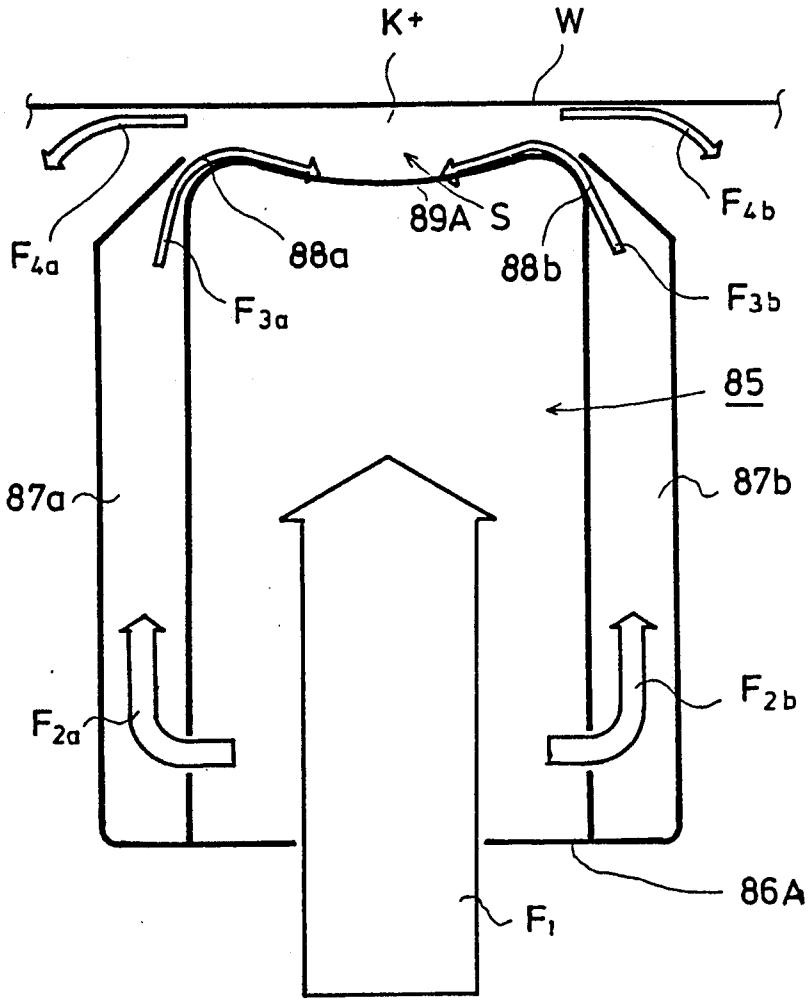
FIG. 2C shows a two-sidedly blowing pressure nozzle unit applied in an airborne web dryer in accordance with the invention.

FIGS. 2C and 2D show two alternative constructions of the nozzle 85 for the airborne web dryer 80. FIG. 2C shows a float nozzle, which comprises a box part 86A, into which the air flow is passed in the direction of the arrow $F_1$. The hot and drying air flow is distributed into the lateral ducts 87*a* and 87*b* placed at the sides of the nozzle box 86A, into which ducts the component flows $F_{2a}$ and $F_{2b}$ of the flow $F_1$ are directed. At the ends of the lateral ducts 87*a* and 87*b* placed next to the web W, there are nozzle slots 88A and 88B, which blow the jets $F_{3a}$ and $F_{3b}$, one opposite the other, along the carrying face 89A for the web W. In the middle of the carrying face 89, there is a recess S. In the manner described above, a pressurized drying area K+ stabilizing the web is formed, out of which area the air is discharged as flows $F_{4a}$, $F_{4b}$ to the sides of the nozzle box 85, so that sufficient turbulence and good heat transfer are formed between the blow-air jets and the web W.

FIG. 2D shows a second, alternative nozzle of the foil type, which comprises a nozzle box 86B, wherein there is one lateral 87, whose end placed next to the web W is provided with a nozzle slot 88. The air flow is passed into the nozzle box 86B as a flow $F_1$, which is divided into the lateral duct 87 as a flow $F_2$, which is discharged as a jet $F_3$ along a coanda face 88C placed after the nozzle 88, following the face 88C within the sector a and being detached from the carrying face before the plane carrying face 89B, in connection with which a carrying face with negative pressure and a drying gap K− are formed, the air being discharged from the said drying gap K− as a flow $F_4$ in the direction shown by the arrow into the spaces between the nozzle boxes 85. FIG. 2 shows how the nozzles shown in FIGS. 2C and 2D are placed relative each other. In the airborne web dryer in accordance with the invention, it is also possible to use nozzles different from those shown in FIGS. 2C and/or 2D.

Figure 4A:
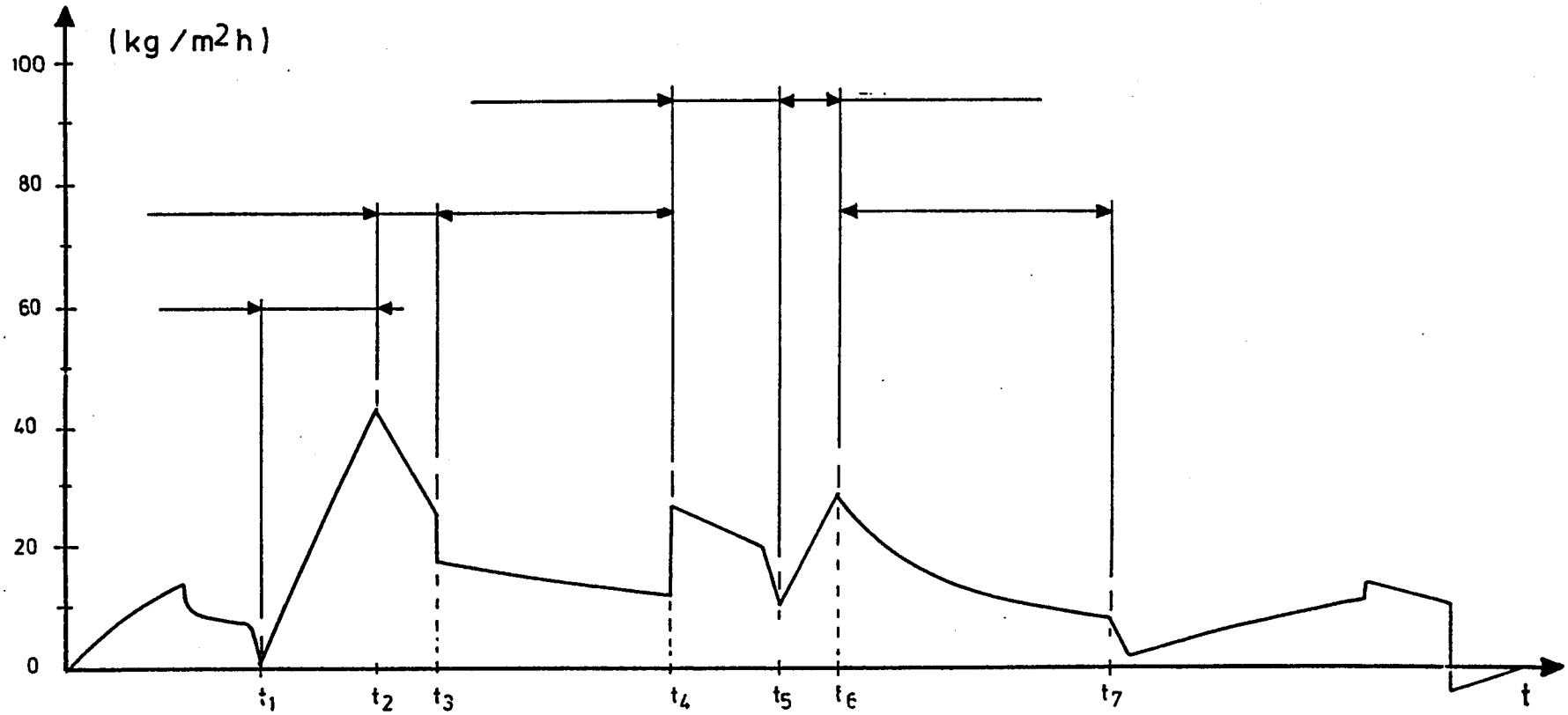
FIG. 4A shows the evaporating capacity of a prior art dryer that comprises two separate infrared units as a function of time.
Figure 4B:
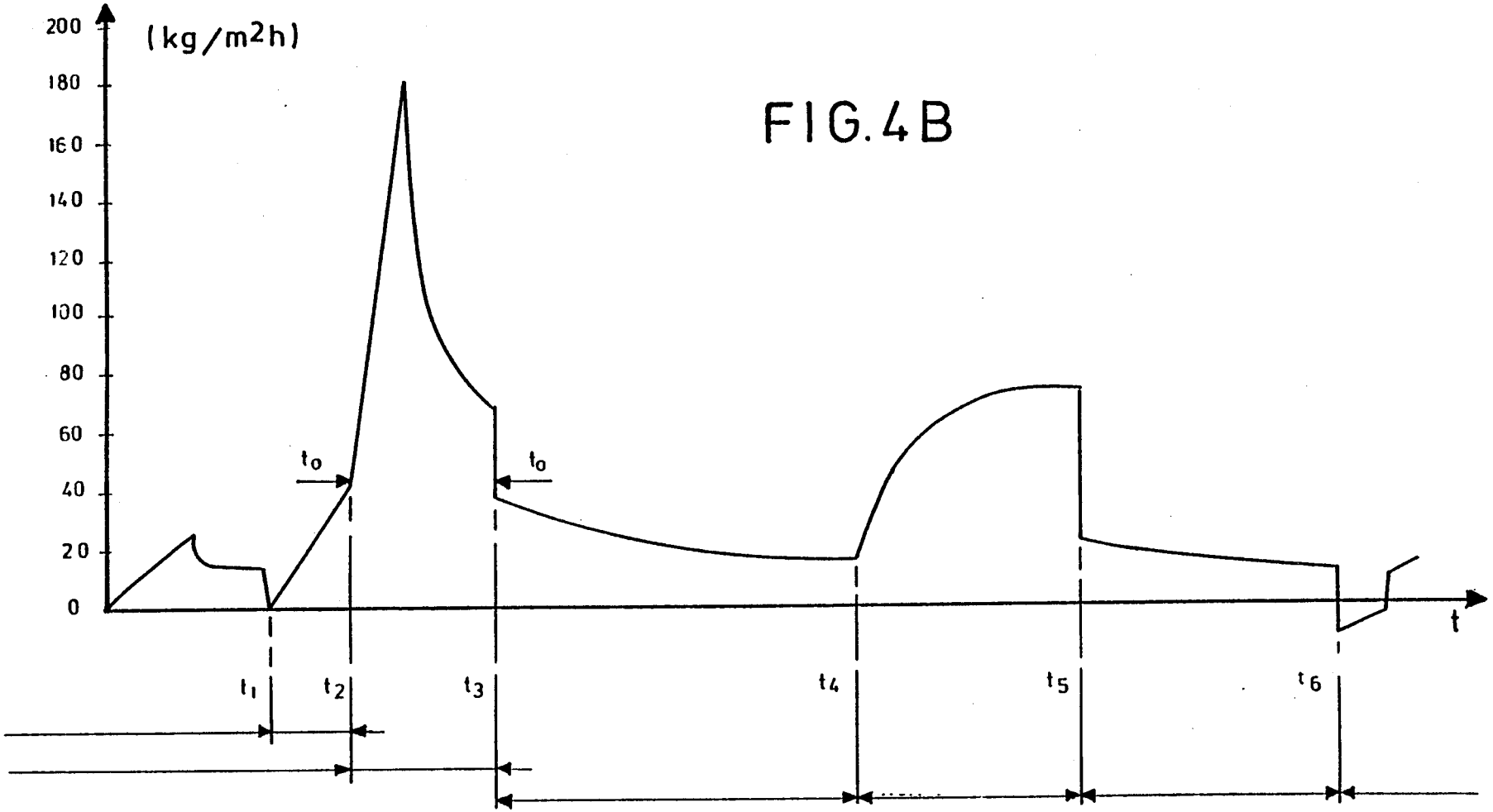
FIG. 4B shows, in a way corresponding to FIG. 4A, the evaporating capacity of the infra-airborne dryer in accordance with the invention and shown in FIG. 1 as a function of time.
Figure 5:
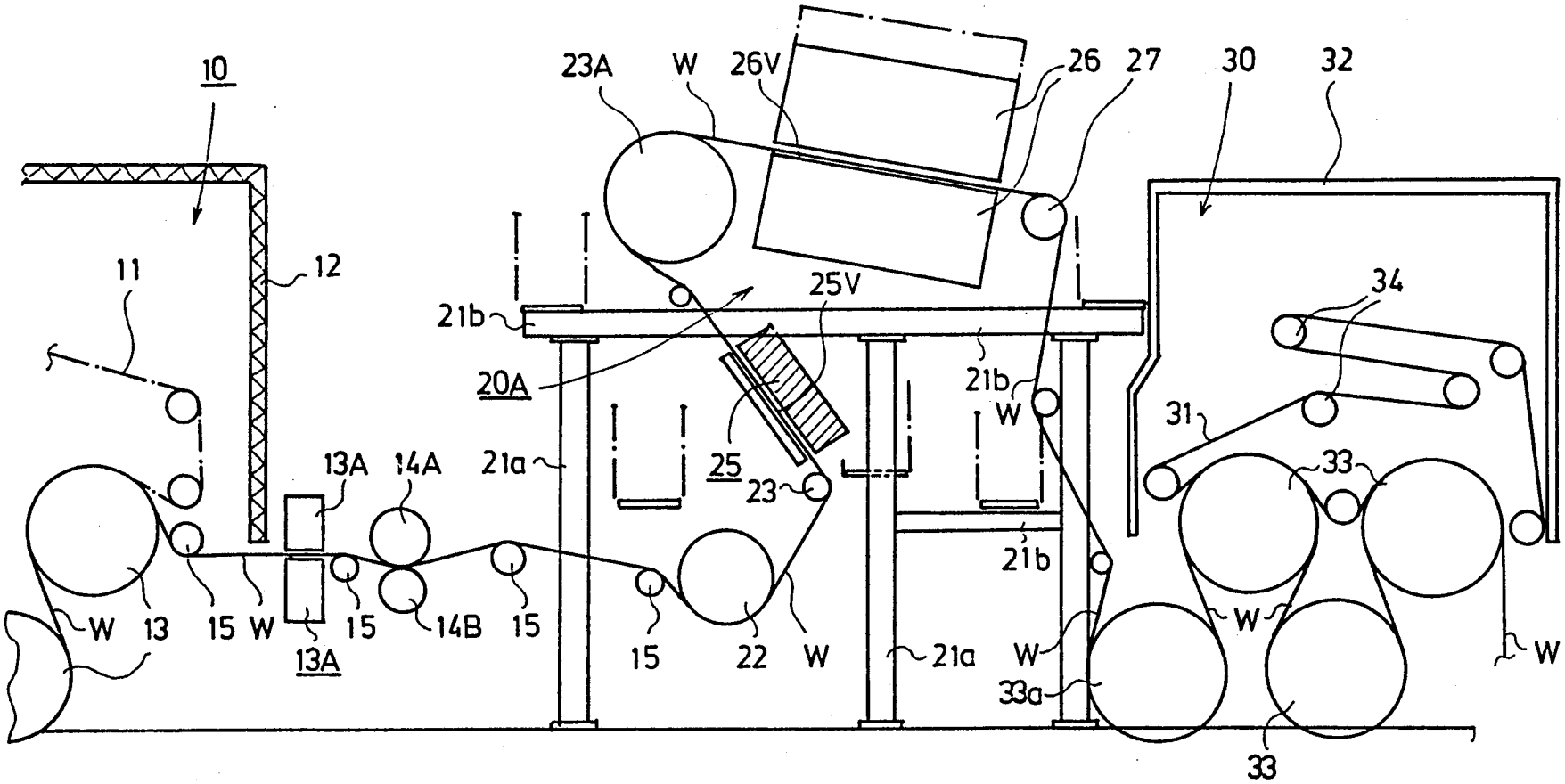

FIGS. 4A and 4B show a graphic comparison of the evaporating capacities (kg/m²h) of the prior art dryer shown in FIG. A and the dryer in accordance with the present invention shown in FIG. 1.

According to FIG. 4A, in a prior art dryer of the type shown in FIG. A, which consists of two separate infrared dryers and a leading cylinder placed between them, the evaporation within the area of the first infrared unit, i.e. within the time period $t_1$–$t_2$, rises to the level of about 40 kg/m²h, whereinafter on the open draw following after the first infrared unit, the evaporation is lowered, within the time period $t_2$–$t_3$, to the level of about 25 kg/m²h. Hereupon, within the area of the leading cylinder (23A), the evaporation remains at a low level and rises to a level of about 25 kg/m²h at the time $t_4$, where the open draw after the leading cylinder (23A) starts. The time period $t_5$–$t_6$ represents the second infrared unit, which is located in place of the airborne web dryer 26 shown in FIG. A. Hereinafter there follows an open draw within the time period $t_6$–$t_7$, whereat the evaporation is lowered substantially exponentially.

When the evaporating capacity of the infrared airborne web dryer in accordance with the invention shown in FIG. 4B, is compared with that illustrated in FIG. 4A, the following can be noticed. Within the time period $t_1$–$t_2$ the web runs through the infrared-treatment gap of the infrared-treatment unit 50 in accordance with the invention. The length of the said infrared-treatment gap is, e.g., about 400 mm. Within the said time period $t_1$–$t_2$ the evaporation capacity rises from zero to the level of about 40 kg/m²h, whereinafter, within the time period $t_2$–$t_3$, there follows the treatment gap 80V of the airborne unit 80 of the dryer in accordance with the invention. From the time $t_2$ the evaporation rises very steeply so that an evaporation peak $Hp_1$ is formed, whose maximum is at a level of about 180 kg/m²h. After the maximum point of the said evaporation peak, the evaporation capacity becomes lower until the time $t_3$, which represents the final point of the treatment gap 80V, to a level of about 70 kg/m²h. The above evaporation peak $Hp_1$ is highly characteristic of the present invention and is accomplished expressly thereby that in the infrared-treatment gap of the unit 50 evaporating energy can be fed into the structure of the web W, which energy is "discharged" as evaporating capacity in the airborne web treatment gap 80V owing to the efficient ventilation provided therein. In FIG. 4B the width of the evaporation peak $Hp_1$ is denoted with $t_0$. The width $t_0$ of the evaporation peak is as a rule, within the range of $t_0$=0.1 to 0.5 s, preferably $t_0$=0.15 to 0.3. In FIG. 4B, $t_0 \sim 0.2$ s when the web W speed $V_0$=10 m/s. The length of the air-treatment gap 80V, which represents the said time period $t_2$–$t_3$, is about 2 m. After the said evaporation peak $t_0$ the evaporation capacity is lowered within the time period $t_3$–$t_4$, which represents the open draw of the web W between the infrared-airborne unit 40 and the following conventional airborne unit 90 in FIG. 1. After this, in the treatment gap 90V of the airborne web drying unit 90, which is represented by the time period $t_4$–$t_5$ in FIG. 4B, the drying capacity rises substantially exponentially to the level of about 80 kg/m²h, whereupon it is suddenly lowered to the level of about 20 kg/m²h, where the evaporation takes place within an open draw before the multi-cylinder dryer, which is represented by the time period $t_5$–$t_6$ in FIG. 4B.

As is seen from FIG. 2, the treatment gap in the infrared unit 50 and the treatment gap 80V in the airborne web drying unit 80 are in the same plane, so that the web W makes no bends when it runs through the combined infrared-airborne dryer 40. Owing to the sealing and accompanying flows $F_A$ and $F_B$, the web W can be made, even initially, to run in a stable way into and through the infrared-treatment gap, and the stabilized run of the web W continues in the treatment gap 80V of the airborne web drying unit 80. It is partly due to this that quite high web speeds can be used, which may be even considerably higher than 1000 m/min.

In this way it is possible to cause water to evaporate rapidly from the face of the web W coating, and in the airborne web drying unit 80 following immediately after the infrared unit 50, the location of the solid area in the coating base can be adjusted favorably so that it becomes placed, e.g., in the free space after the airborne web drying unit 80. In this way, an occurence of the mottling phenomenon can be prevented. A strong evaporation peak $H_{p1}$ immediately after the coating process also reduces the occurence of fibre roughening.

FIG. 3 shows an exemplifying embodiment of an air system applicable in connection with the method and device of the present invention. The drying air is passed through the duct 100 into a filter 101 and from there further into the intake duct 102 of the blower 103. The pressure duct 104 of the blower 103 communicates via the pipes 52A,53A and 52B,53B with the boxes 51A,54A and 51B,54B of the infrared unit, from which flows are branched so as to constitute the accompanying flows $F_A$ and $F_B$ discharged from the nozzles 55A and 55B and shown in FIG. 2. The air cooling the infrared unit 50 is recovered so as to constitute replacement air for the airborne web drying unit 80 and/or 90.

According to FIG. 3, an intake duct 105 starts from the chambers 106A and 106B, through which duct 105 air is passed to the suction side of the blower 107 of the airborne web drying unit 80 so as to constitute burning air for the burner 116. The regulator of the intake side is denoted with the reference numeral 120. The duct at the pressure side of the blower 107 is passed to a gas burner 116, to which the duct at the pressure side of the second blower 113 is also passed. In connection with the suction duct 115 of the blower 113, there is a regulator 121. The duct 110 at the outlet side of the gas burner 116 passes the hot and dry air into the nozzle boxes 82A and 82B of the airborne web drying unit 80. The air is taken from the nozzle boxes 82A and 82B through the duct 111 into the duct 115. Between the ducts 110 and 111, there is a by-passing duct 112, which is provided with regulators 114. The ducts 115 and 111 pass to the exhaust duct 122, and from there further to the duct 131 of the suction side of the exhaust blower 132, in which duct 131 there is a regulator 133. Between the ducts 105 and 112, there is a blower 125. The cooling-air duct 105 of the infrared unit 50 is also passed to the suction duct of the burning-air blower 140 of a separate infrared unit 90 as well as to the exhaust duct 130 of a separate airborne web drying unit 90. In the other respects, the air arrangement of the separate airborne web drying unit 90 is similar to the air arrangement described above in respect to the airborne web drying unit 80.

In the embodiment shown in FIGS. 1 and 3, the electric power $P_S$ passed to the infrared unit 50 through the conductor 150 is, e.g., of an order of $P_S=740$ kW, and the heating power $P_1$ of the blowing air for the airborne part 80 of the infrared-airborne dryer 40 (gas burner 116) is of an order of $P_1=300$ kW. The heating power of the blowing air of a conventional airborne web dryer 90 is, e.g., of an order of $P_2=1300$ kW.

In the applications in accordance with the invention, the electric power of the infrared unit 50 is preferably $P_S=(2\ldots3)\times P_1$. If one thinks of the overall power of the dryers 40 and 90 in a coating station 20, it is, in the case shown in FIGS. 1 and 3, $P_{tot}=P_S+P_1+P_2=740+300+1300=2340$ kW. Preferably, in the invention, the electric power $P_S$ of the infrared unit 50 is about 25 to 40% of the overall power $P_{tot}$, preferably 30 to 35%. From the above it can be noticed that in the invention it is possible to operate with a relatively low proportion of more expensive electric power P, and the air-heating energies $P_1$ and $P_2$ can be taken advantageously from natural gas, if it is available, or from some other corresponding energy that is less expensive than electric energy. Thus, owing to the invention, the favorable effects of infrared drying can be obtained with a relatively low proportion of electric energy.

It should be understood that the preferred embodiments and examples described are for illustrative purposes only and are not to be construed as limiting the scope of the present invention which is properly delineated only in the appended claims.

What is claimed is:

1. A method of contact-free drying a paper or board web (W) wherein both infrared radiation (R) and drying air jets are used for drying, said drying air jets carrying said web (W) free of contact as said web moves through said dryer, and wherein after said infrared drying step said web is substantially immediately moved into an airborne web-dryer wherein said web is supported by and dried with air jets, the method comprising:

passing said moving web into an infrared drying gap of an infrared dryer (50);

directing a short duration drying energy pulse at said web, the power of said energy pulse being substantially higher than the average drying power of the dryer per unit of area;

introducing an unheated air flow ($F_{Ain}$, $F_{Bin}$) into said infrared dryer (50);

heating said air in said infrared dryer; and substantially immediately passing said heated air from said infrared dryer to said airborne web dryer (80, 90) for use as replacement air and/or drying air therein.

2. The method according to claim 1, wherein said air flow is introduced into the inlet gap (G) of said infrared dryer and is passed along both sides of said web so as to support said web within said infrared drying gap.

3. The method according to claim 1, additionally comprising the steps of drying and supporting said web after said infrared and airborne dryer free of contact in a second airborne web dryer.

4. The method according to claim 1, wherein said replacement air passed into said airborne web dryer is taken exclusively from said air ($F_{Ain}$, $F_{Bin}$) introduced into said infrared dryer (50), and utilizing said air for cooling and additionally for sealing the inlet gap (G) of said infrared dryer for supporting said web and for accompanying said web essentially along the entire length of said infrared drying gap.

5. The method according to claim 1, wherein the electric power ($P_s$) generating said infrared radiation (R) applied to said web in said infrared web dryer (50) is between about 2–3 times as high as the power ($P_1$) used in said airborne web dryer (80) for heating the drying air therein.

6. The method according to claim 1, wherein the electric power ($P_s$) generating said infrared radiation (R) applied to said web is between about 25 and about 40% of the total drying power ($P_{tot}$) applied to said web in said dryer.

7. The method according to claim 1, wherein the electric power ($P_s$) generating said infrared radiation applied to said web is between about 30 and about 35% of the total drying power ($P_{tot}$) applied to said web in said dryer.

8. The method according to claim 1, wherein gas is used for heating said drying air in said airborne web dryer.

* * * * *